US009624690B2

(12) United States Patent
Lawrence

(10) Patent No.: US 9,624,690 B2
(45) Date of Patent: Apr. 18, 2017

(54) POST PULLER AND RELATED METHOD USING A LIFTING ACTION OF A WORKING MACHINE TO ACTUATE CAM-SHAPED GRIPPERS OF THE POST PULLER

(71) Applicant: David Lawrence, Hamiota (CA)

(72) Inventor: David Lawrence, Hamiota (CA)

( * ) Notice: Subject to any disclaimer, the term of this patent is extended or adjusted under 35 U.S.C. 154(b) by 193 days.

(21) Appl. No.: 14/619,764

(22) Filed: Feb. 11, 2015

(65) Prior Publication Data

US 2016/0230414 A1 Aug. 11, 2016

(51) Int. Cl.
*B66F 3/00* (2006.01)
*E04H 17/26* (2006.01)

(52) U.S. Cl.
CPC ..... *E04H 17/265* (2013.01)

(58) Field of Classification Search
CPC ..... B66B 3/00; B66B 1/00; B66B 7/00
See application file for complete search history.

(56) References Cited

U.S. PATENT DOCUMENTS

| | | | | |
|---|---|---|---|---|
| 1,774,661 | A | 9/1930 | Otto | |
| 4,422,621 | A | 12/1983 | Ekern | |
| 4,721,335 | A | 1/1988 | Krenek, Jr. | |
| 5,011,117 | A | 4/1991 | Youngblood et al. | |
| 5,368,277 | A | 11/1994 | Moss | |
| 5,868,060 | A * | 2/1999 | Plank | F15B 15/262 254/134 |
| 7,059,587 | B1 * | 6/2006 | Fimple | E04H 17/265 254/133 R |
| 7,290,754 | B2 | 11/2007 | Mensi et al. | |
| 7,963,051 | B2 | 6/2011 | Ford | |
| 8,453,993 | B2 | 6/2013 | Davis | |
| 8,608,132 | B1 | 12/2013 | Allen | |
| 2002/0063245 | A1 * | 5/2002 | Salman | E02D 13/02 254/30 |
| 2007/0183121 | A1 | 8/2007 | Futrell | |
| 2009/0028649 | A1 | 1/2009 | Ringelstetter et al. | |
| 2012/0279737 | A1 | 11/2012 | Trethewey | |
| 2013/0069025 | A1 * | 3/2013 | Schooley | E04H 17/265 254/30 |
| 2013/0099184 | A1 * | 4/2013 | McNeill | E04H 17/263 254/30 |
| 2016/0230414 | A1 * | 8/2016 | Lawrence | E04H 17/265 |

FOREIGN PATENT DOCUMENTS

| | | |
|---|---|---|
| WO | 2012116405 | 9/2012 |

* cited by examiner

*Primary Examiner* — Lee D Wilson
(74) *Attorney, Agent, or Firm* — Kyle R. Satterthwaite; Ryan W. Dupuis; Ade & Company Inc.

(57) ABSTRACT

A post puller features a lifting member that is slidably disposed on a guide shaft and attachable to a lifting arrangement of a working machine. A pair of movable grippers are pivotally supported on the guide shaft at a fixed position therealong, and a pair of links are pivotally connected between the lifting member and the grippers. With a web or flange of the post received in a space between inner ends of the movable grippers, raising of the lifting member by the working machine lifts the outer ends of the movable grippers via the pair of links, thereby lowering inner ends of the grippers into closer proximity to one another to grip the web or flange of the post between the grippers. With the post gripped in this manner, further raising of the lifting member by the working machine pulls the post from the ground.

9 Claims, 5 Drawing Sheets

POST PULLER AND RELATED METHOD USING A LIFTING ACTION OF A WORKING MACHINE TO ACTUATE CAM-SHAPED GRIPPERS OF THE POST PULLER

FIELD OF THE INVENTION

The present invention relates generally to devices and methods for pulling of metal fence posts or the like from the ground, and more particularly to a solution employing pivotal cam-shaped grippers that are actuated by application of an upward pulling force on the post puller by the lifting arrangement of a working machine.

BACKGROUND

Metal (typically steel) posts or pickets are commonly employed for temporary fencing measures, and most commonly feature a T-shaped, t-shaped, Y-shaped, or star-shaped cross section. In a common temporary fencing setup, a series of posts are driven into the ground at spaced apart positions along the intended fence line, and then wire mesh is strung up between adjacent posts using a series of teeth that are provided on a flange or web of the post. When it becomes desirable to take down or relocate the fence, the mesh is removed and rolled up, and the posts are pulled free of their previously embedded positions in the ground.

A number of devices have been previously proposed for the purpose of pulling posts from the ground, including those disclosed in U.S. patents U.S. Pat. No. 1,774,661, U.S. Pat. No. 4,422,621, U.S. Pat. No. 4,721,335, U.S. Pat. No. 5,011,117, U.S. Pat. No. 5,368,277, U.S. Pat. No. 7,059,587, U.S. Pat. No. 7,290,754, U.S. Pat. No. 7,963,051, U.S. Pat. No. 8,608,132 and U.S. Pat. No. 8,453,993; U.S. Patent Application Publications US2007/0183121, US2012/0279737 and US20090028649; and PCT Publication WO2012116405.

Of these references, U.S. Pat. No. 1,774,661 and U.S. Pat. No. 8,453,993 employ a cam-based post gripping mechanism that is most comparable to that of the present invention, but rely on manual levers to provide the post gripping and pulling forces required to grip the post and pull it free from the ground. Other references make use of external equipment to provide the lifting and gripping force, but not in a manner compatible with a cam-based gripping mechanism like that employed in the present invention.

Applicant has therefore developed a unique solution for actuating post grippers of a post puller using a skid steer, front end loader, excavator, back hoe or other working machine with a powered lifting arrangement.

SUMMARY OF THE INVENTION

According to one aspect of the invention there is provided a post puller for pulling a post from a ground embedded position standing upright from a ground surface, the post puller comprising:

a lifting member having a coupling point thereon that is configured for attachment to lifting arrangement of a working machine to enable upward lifting of said lifting member by the lifting arrangement of the working machine;

a sliding sleeve attached to the lifting member;

a guide shaft about which the sliding sleeve is disposed for axial sliding of the sleeve up and down along a longitudinal axis of the guide shaft;

a pair of movable grippers pivotally supported on the guide shaft by respective pivotal connections on opposing sides of a central longitudinal plane thereof at a fixed location along the longitudinal axis of the guide shaft, each movable gripper having an inner end with a cam-shaped gripping surface that faces across the central longitudinal plane of the guide shaft toward the cam-shaped gripping surface of the other movable gripper, and an opposing outer end spaced laterally outward to a respective side of the guide shaft, each cam-shaped gripping surface increasing in a radial distance thereof from a pivot axis of the respective pivotal connection in a direction moving upward from an imaginary axis intersecting the pivot axes of the pivotal connections;

a pair of links having upper ends pivotally coupled to the lifting member and respective lower ends each pivotally coupled to a respective one of the movable grippers proximate the outer end thereof, whereby raising of the lifting member by the working machine with a web or flange of the post received in a space between the inner ends of the movable grippers lifts the outer ends of the movable grippers via the pair of links, thereby lowering the inner ends of the grippers about the pivot axis and bringing the cam-shaped gripping surfaces into closer proximity to one another to grip the web or flange of the post between the gripping surfaces and pull the post from the embedded position under further raising of the lifting member by the working machine.

Preferably there are provided upper and lower braces situated above and below the movable grippers on a same side of the guide post as said movable grippers, each brace defining a slot for receiving the web or flange of the post therein to align the web or flange in the space between the inner ends of the grippers.

Preferably there is provided a ledge projecting outward from the guide shaft to a same side thereof at which the movable grippers are disposed for resting of said ledge atop the post during placement of the post puller in an operational position situating the web or flange of the post in the space between the inner ends of the grippers.

Preferably the ledge resides at a position above the upper brace.

Preferably the lower brace resides below the fixed position of the movable grippers at a further distance therefrom than the upper brace.

Preferably there is provided at least one handle attached to the guide shaft.

Preferably the at least one handle extends to a side of the guide shaft opposite the movable grippers.

Preferably the at least one handle comprises a pair of handles each extending laterally outward from the post to a respective side thereof in opposing directions away from the central longitudinal plane of the guide shaft.

Preferably each handle comprises an open grip handle having upper and lower arms attached to the guide shaft at spaced apart positions along the longitudinal axis, a central span joining the upper and lower arms together at a radial distance outward from the guide shaft, and an open space bound between the arms, the central span and the guide shaft for gripping of the handle through said open space.

According to a second aspect of the invention, there is provided a method of pulling a post from a ground embedded position standing upright from a ground surface, the method comprising:

(a) positioning the post puller according to anyone of claims 1 to 9 in an operating position in which the web or flange of the post is received in the space between the movable grippers;

(b) supporting the post puller in the operating position independently of the lifting member thereof such that lifting member and links are gravitationally biased downward to push downwardly on the outer ends of the gripping members and raise the inner ends of the gripping members into an open position maximizing the space between the cam shaped gripping surfaces of the gripping members;

(c) pulling upwardly on the lifting member using the lifting arrangement of the working machine, and thereby displacing the sliding sleeve upwardly along the guide shaft and pivoting the movable grippers in a direction moving the cam-shaped gripping surfaces closer together and into frictional engagement with the flange or web received in the space between the gripping surfaces; and (d) with the flange or web frictionally gripped between the gripping surfaces of the movable grippers, pulling the lifting member further upward using the lifting arrangement of the working machine, thereby pulling the post out of the embedded position.

Supporting the post puller independently of the lifting member in step (b) preferably comprises seating the post puller atop the post at an upper end thereof.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
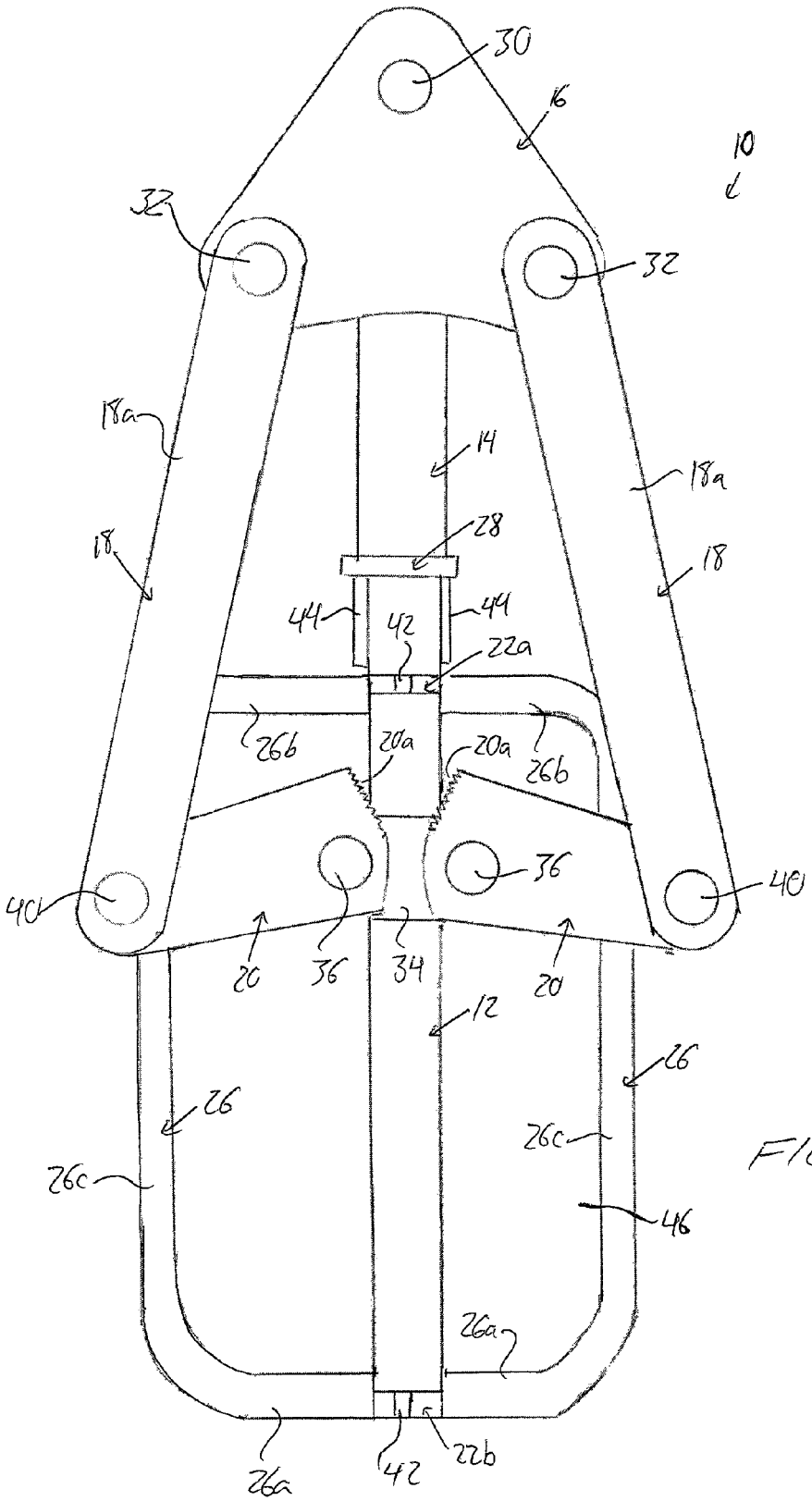
FIG. 1 is an elevational front view of a post puller of the present invention in a ready state for acceptance of a web or flange of a post (not shown) between two movable grippers of the puller.

FIGS. 1 to 4 illustrate a post puller 10 according to one embodiment of the present invention, which is generally made up of a upright guide shaft 12, a hollow sliding sleeve 14, a lifting member 16, a pair of links 18, a pair of movable grippers 20, a pair of braces 22, a resting ledge 28 and a pair of handles 26. The terms vertical and horizontal are used herein in relation to the illustrated orientation of the post puller shown in the drawings, in which the guide shaft 12 stands vertically upright so as to lie parallel to a vertical fence post when used thereon. However, in actual practice, fence posts will of course not always stand truly vertical, and so the orientation of the tool will likewise deviate from the vertical orientation described and shown. The terms horizontal and vertical are therefore used only to distinguish the components that lie more vertical than horizontal from those that lie more horizontal than vertical.

The guide shaft 12 and sliding sleeve 14 are both formed of rectangular metal tubing, and the sliding sleeve 14 has a slightly larger cross-sectional area and is concentrically disposed around the guide shaft 12 for sliding movement upwardly and downwardly therealong in the upright longitudinal direction of the shaft 12. A resting ledge 28 in the form of a small flat horizontal plate welded or otherwise attached to the shaft extends forwardly therefrom at a distance below the top end of the shaft 12. The sliding sleeve is disposed around the shaft 12 at the portion thereof residing above this resting ledge 28. The ledge 28 thus defines a stop that prevents the sleeve 14 from sliding downwardly past the ledge 28, thereby constraining the sleeve's range of travel to an upper portion of the guide shaft 12.

The lifting member 16 is a flat plate welded or otherwise attached to the front side of the sliding sleeve 14 in a position residing parallel thereto at a short distance forwardly outward therefrom. A coupling point 30 is provided near the top of the lifting member 16 in the form of a through-hole passing horizontally therethrough. Near two lower corners of the lifting member 16, the two links 18 are respectively coupled to the front face of the lifting member 16 by respective pivot pins 32 passing horizontally through the lifting member 16 in the same direction as the coupling point through hole 30. As a result, each link 18 is pivotal about a horizontal pivot axis that passes perpendicularly through the lifting member plate 16. The links are therefore pivotal within a vertical plane lying parallel to the lifting member plate 16 on the front side thereof opposite the shaft 12.

At an intermediate location along the length of the shaft 12, a mounting bracket 34 is welded or otherwise attached thereto in a position jutting outwardly from the shaft 12 on at least the front and lateral sides thereof. At a front end of the bracket 34, each one of the movable grippers 20 is pivotally coupled thereto by a respective pivot pin 36 that passes horizontally through the mounting bracket 34 on a respective side of the shaft 12 in a direction parallel to the pivot pins 32 at the upper ends of the links 18. A respective cotter pin 38 or other suitable locking secures each of the pivot pins 36 in place by cooperating with the head **36*a* of each pivot pin 36 at the other end thereof to prevent sliding of the pivot pin out of the mounting bracket 34 in either direction. This set of pivot pins 36 cooperates with the mounting bracket 34 affixed on the shaft to pivotally mount the movable grippers 20 on the shaft, and therefore may also be referred to herein as mounting pins 36** in order to better distinguish same over the other pivot pins used elsewhere in the assembled post puller.

Yet another pair of pivot pins 36 are used to pivotally connect the movable gripping members 20 to the links 18 that hang downwardly from the lifting member 16. These pivot pins 36 are also referred to herein as connection pins 40 to better distinguish same over the other pivot pins in the assembled post puller. Each connection pin 40 extends through the respective gripper 20 near the outer end thereof that lies distal to the guide shaft 12, and lies parallel to the other two sets of pivot pins 32, 36. The mounting pins 36 extend through the movable grippers 36 near the inner ends thereof that reside adjacent to a central longitudinal plane of the shaft 12 on opposite sides of this central longitudinal plane. The inner end of each movable gripper 20 is curved non-concentrically around the axis of the respective mounting pin 36 to create a cam-shape that increases in its radial distance from the mounting pin axis in a direction moving upward from an imaginary horizontal axis that perpendicularly intersects the axes of the mounting pins 36. An upper portion of the inner end of each gripper 20 is serrated to define a series of gripping teeth, therefore defining a gripping surface **20*a*** that faces toward that of the other gripper across the gap or open space left between the inner ends of the grippers.

An upper brace 22*a* of the post puller resides at a location below the resting ledge 28 and above the mounting bracket and movable grippers. The brace 22 features a small horizontal plate welded or otherwise attached to the shaft 12 in a position projecting forwardly outward from the front side thereof on the same side of the shaft 12 as the linkage formed by the lifting member 16, links 18 and grippers 20. A lower brace 22*b* likewise projects forwardly from the shaft, but at the lower end thereof situated at a distance below the mounting bracket and movable grippers 20. Each brace 22*a*, 22*b* features a linear slot 42 that cuts into the brace plate from the distal end thereof that lies opposite to the shaft 12, whereby the remaining intact portions of the brace plate on opposite sides of the slot define a pair of tongs. Beneath the ledge 28, a pair of side walls 44 depend vertically downward from the ledge 28 toward the upper brace 22*a* on opposite sides of the shaft 12. In the illustrated embodiment, the resting ledge 28, upper brace 22*a* and side walls 44 are separately defined by respective plates, but in other embodiments, one or more of these components may be integrally combined into a single piece unit. For example, the resting ledge 28, upper brace 22*a* and side walls 44 may be integrally defined by a piece of rectangular tubing that is laser-cut or otherwise configured into a suitable shape for mounting to the guide shaft.

Completing the structure of the post puller are the pair of handles 26, each of which is provided in the form of a three-segment bar. Each bar-type handle 26 has a lower arm 26*a* jutting horizontally outward from the shaft 12 at or near the lower end thereof at an oblique angle so as to span laterally and rearwardly away from the shaft 12. A similar upper arm 26*b* likewise juts horizontally outward from the shaft at an oblique angle matching that of the lower arm 26*a*, but farther up the shaft 12, for example at the same elevation as the upper brace 22*a*. A central span 26*c* of each bar-type handle spans vertically between the upper and lower arms 26*a*, 26*b* thereof to complete an open-handle configuration that features an open handle space 46 bound by cooperation of the arms and central span of the handle with the shaft 12.

Having defined the structure of the post puller, attention is now turned to the operation of its grippers. Due to the linkage defined by the pivotal connection of the links 18 between the lifting member 16 and the grippers 20, raising of the lifting member 16 relative to the shaft 12 pulls the outer ends of the grippers 20 upward about the axes of mounting pins 36, which causes the inner ends of the grippers 20 to pivot downwardly about the axes of the mounting pins 36. Due to the cam-shaped configuration of the serrated gripping surfaces 20*a* of the grippers 20, this causes the gripping surfaces 20*a* to move closer together across the central longitudinal plane of the shaft 12, thereby reducing the width of the gap or space therebetween. FIG. 1 shows the post puller in its default ready state, where the weight of the sleeve 14 and attached lifting member gravitationally bias the lifting member 16 into a lowered position seated atop the resting ledge 28. This gravitational action biases the outer ends of the grippers 20 downwardly about the axes of the mounting pins 36, which in turn biases the gripping surfaces 20*a* at the inner ends of the grippers upwardly about these axis, and away from one another. Accordingly, in the default state of the post puller, the gap or space between the gripping surfaces 20*a* of the grippers is maximized.

Figure 2:
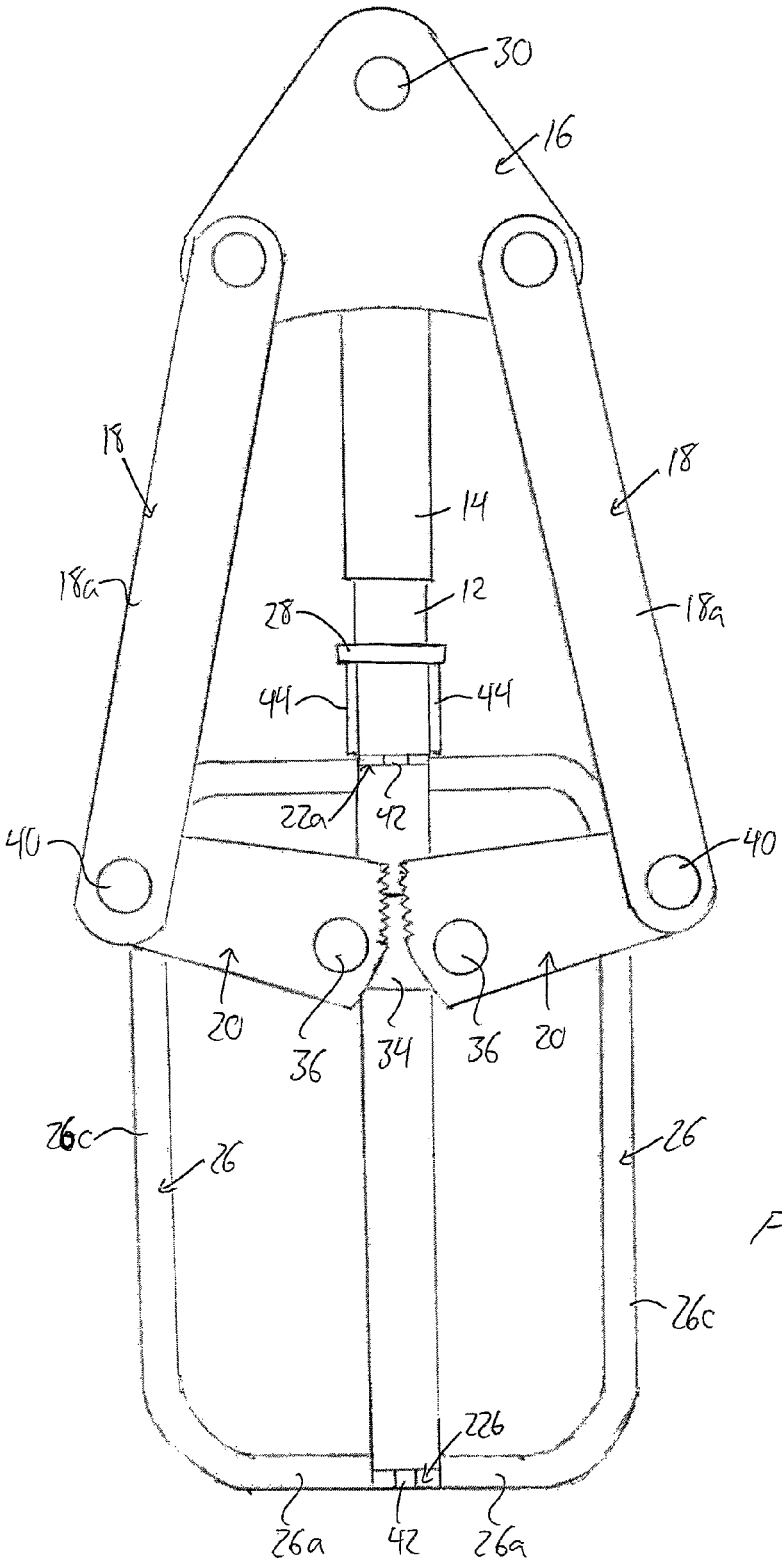
FIG. 2 is an elevational front view of the post puller in an actuated state gripping state in which gripping surfaces of the grippers have been brought together for the purpose of gripping the web or flange of the post (not shown) between the grippers.

With reference to FIG. 2, when the lifting member 16 is lifted up relative to the shaft, thereby lifting the sleeve 14 up off of the resting ledge 28, this lifting action raises the outer ends of the grippers 20 about the axes of the mounting pins 36, which in turn lowers the inner ends of the grippers about the axes of the mounting pins and thereby forces the serrated gripping surfaces 20*a* at the inner ends of the grippers toward the central longitudinal plane of the shaft, thus moving these gripping surfaces closer together to reduce the width of the gap or space between them.

Figure 3:
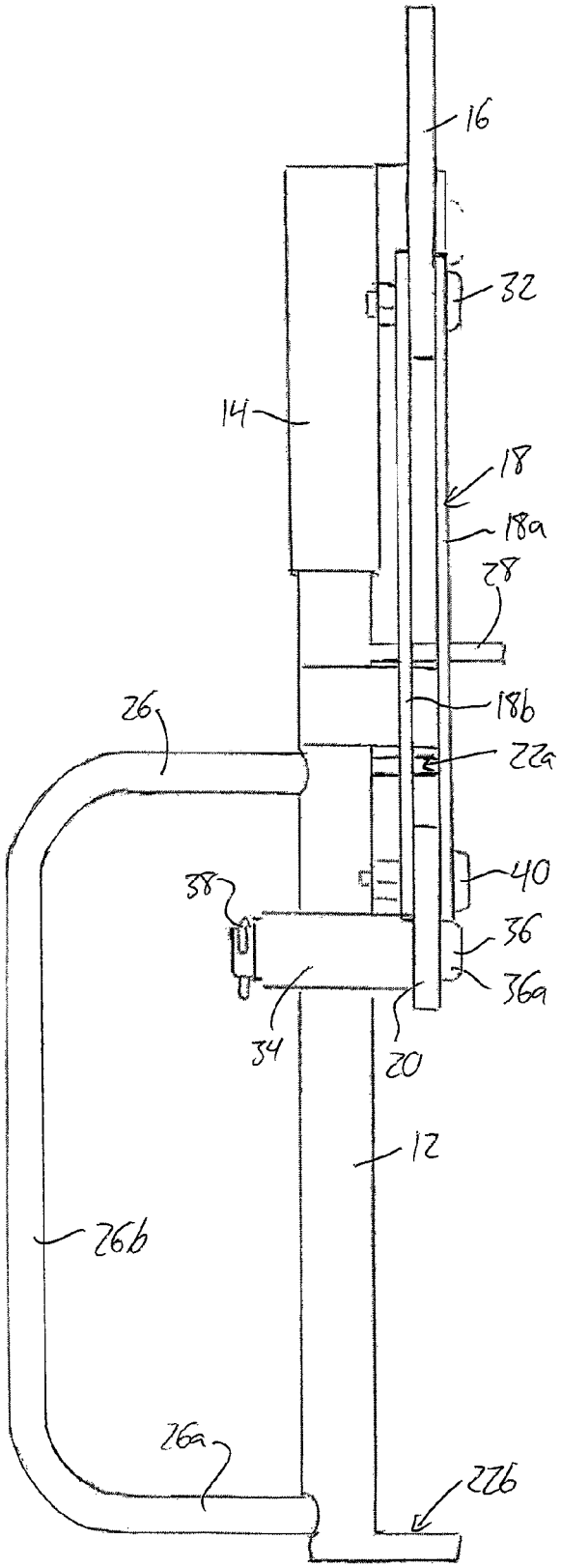
FIG. 3 is an elevational side view of the post puller.
Figure 4:
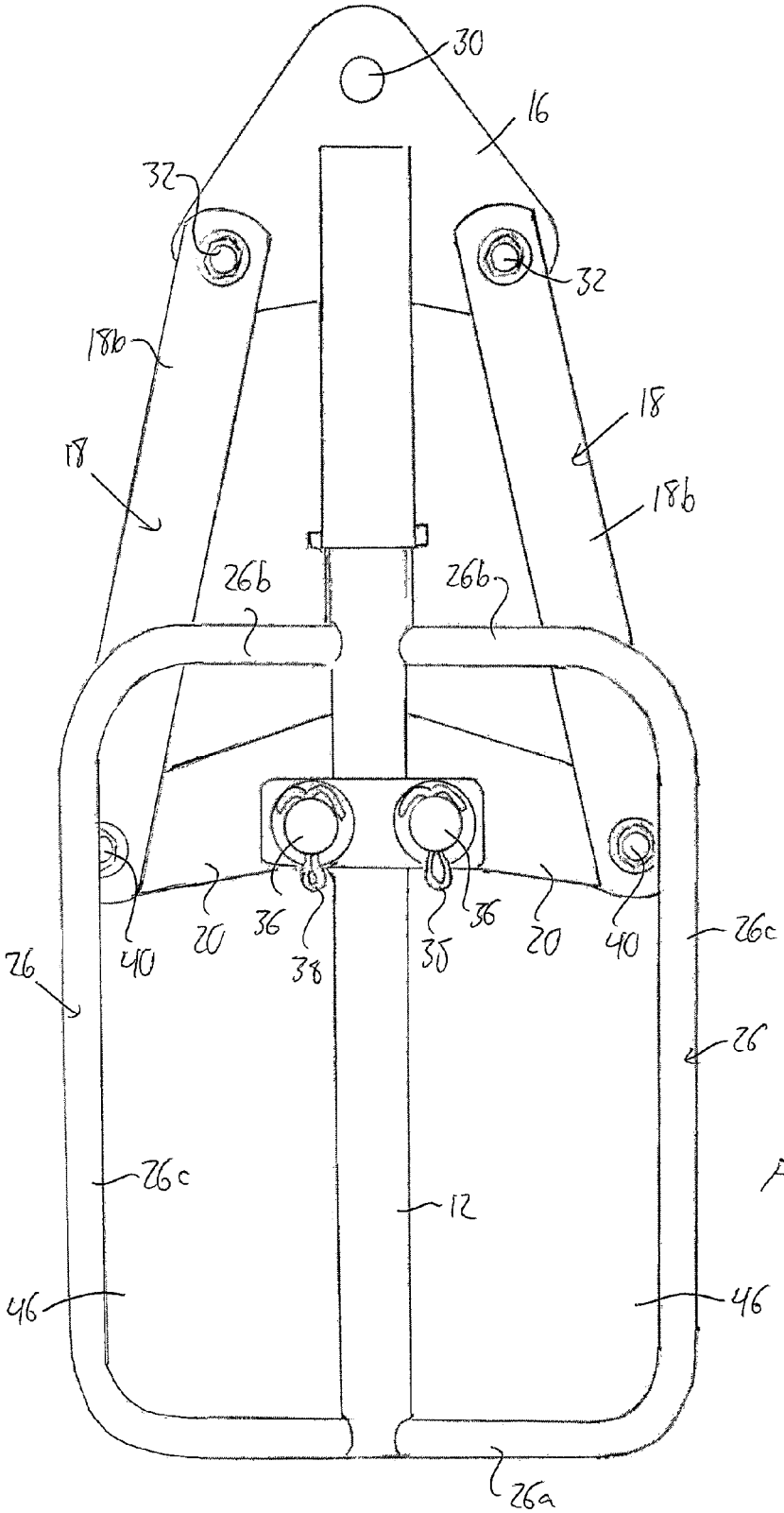
FIG. 4 is a rear elevational view of the post puller in the ready state.
Figure 5:
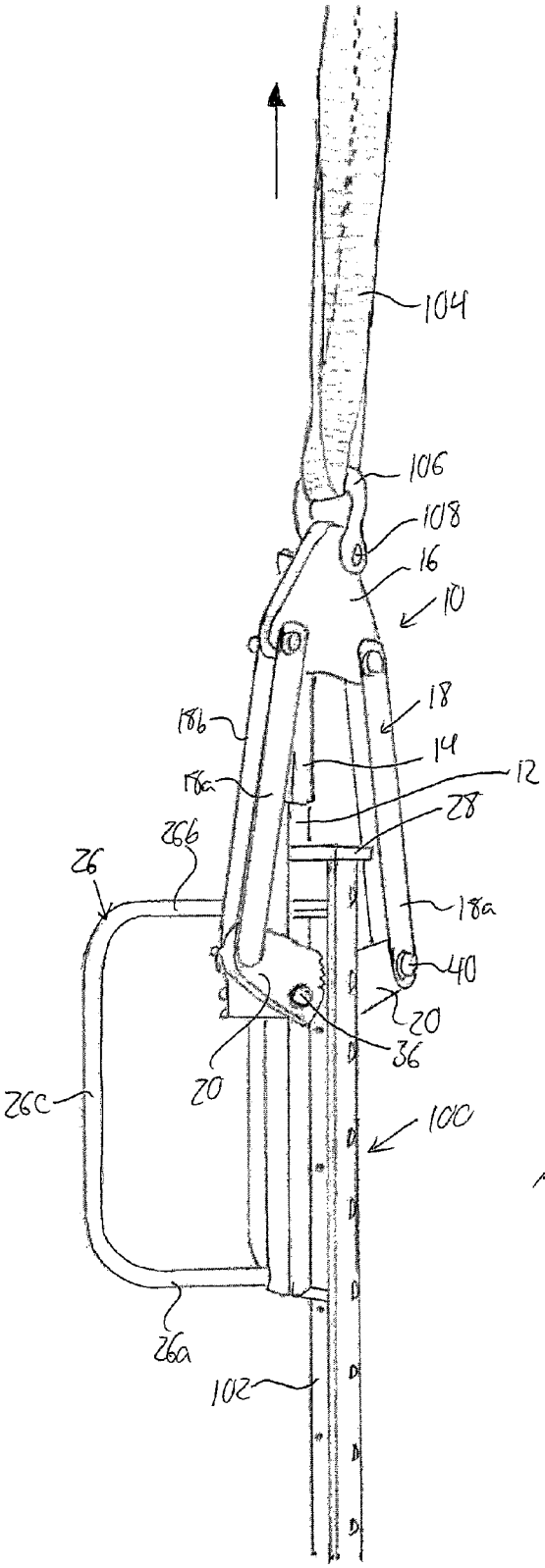
FIG. 5 is a perspective view of the post puller in the gripping state during use, in which the post puller is lifted by a cable, strap, or line coupled to the lifting arms of a skid steer, front end loader, excavator, back hoe, or other working machine.

Turning to FIG. 5, use of the post puller to remove a post 100 from its embedded position in the ground is now described as follows. A user grips the two handles 26 in his or her hands and uses same to manually lift the post puller to a position raising the resting ledge 28 to a height great than the top end of the post 100. With the slots 42 in the two braces 22*a*, 22*b* aligned with a web or flange 102 of the post 100, the post puller is manually displaced in a horizontal direction toward the post from the side thereof to which this web or flange 102 extends, until either the free outer edge of the web or flange bottoms out in the slots of the braces 22*a*, 22*b* or the distal ends of the prongs of the braces 22*a*, 22*b* are brought into contact with other flanges of the post 100. As best seen in FIG. 3, the distance by which the resting ledge 28 projects from the shaft 12 is greater than the projecting distance of the braces 22*a*, 22*b*, whereby this horizontal shifting of the braces into engagement with the post acts to place the resting ledge 28 in a position overlying the top end of the post, thereby effectively seating or hanging the post puller on the post 100. The side walls 44 beneath the resting ledge prevent the post puller from falling laterally off the top end of the post.

Turning back to FIG. 5, a strap, cable, chain, rope or other flexible lifting line 104 is connected to the lifting member 16, for example by coupling a clevis 106 to the lifting member 16 by way of a clevis pin 108 fed through the coupling point hole 30 at the top of the lifting member 16. The other end of the flexible lifting line 104 is securely fastened to the lifting arrangement of a skid steer loader, front end loader, excavator, back hoe or other working machine having a raisable and lowerable lifting arrangement. The lifting line 104 may be coupled to a bucket or other implement mounted on the lifting arms or boom of such a working machine, or coupled directly to the lifting arms or boom if a suitable connection point is found thereon. The flexible lifting line may be connected to the lifting member of the post puller prior to placement of the post puller onto the post, and optionally used to help in the initial lifting of same, provided that the final placement of the post puller onto the post is performed manually so as to leave slack in the lifting line so that the upward pulling force on the lifting member is removed to allow the grippers to move into their default open position in which the gap space between them is greater than the width of the flange or web of the post.

With post puller seated atop the post, as shown in FIG. 5, the lifting arrangement of the working machine is raised, thereby pulling upward on the lifting member 16 of the post puller to cause the gripping surfaces of the grippers 20 to move toward one another and frictionally grip the web or flange 102 of the post 100 between them, whereupon continued raising of the lifting arrangement of the working machine will pull the post free from the ground.

As best shown in FIG. 3, each link 18 of the illustrated embodiment is made up of two matching link plates 18*a*, 18*b* disposed in front of and behind the plane of the lifting member 16 and grippers 20, but it will be appreciated that each link may alternatively be defined by a single unitary piece. Likewise, although the inclusion of two braces 22*a*, 22*b* spaced notably apart along the longitudinal direction of the shaft provides an effective stabilizing function to keep the post puller 10 in-line with the post 100, it may be possible to rely on only a single brace, or to even omit the braces altogether without detriment to the gripping and pull efficiency of the post puller 10. Likewise, the inclusion or configuration of the handles may vary, although the use of two obliquely oriented handles 26 that extend both rearwardly and laterally from the shaft provide for a confident two-handed grip that is balanced across the shaft while keeping the user's hands well back from the post/puller interface during use to avoid inadvertent injury.

Although the use of rectangular tubing maintains proper alignment of the lifting member and links with the shaft-carried grippers at the front side of the shaft, tubing of other non-circular cross-sectional shape may similarly maintain such alignment by preventing relative rotation between the shaft and sleeve to minimize stress on the linkage. Alternatively, circular tubing may be used, either with suitable anti-rotation means acting between the shaft and tube or relying on the linkage itself to self-maintain alignment between its components. Although a hollow shaft is in the best interest of weight reduction and material efficiency, the invention is not limited specifically to the use of a hollow tubing to define the guide shaft for the sliding movement of the sleeve.

In addition to being usable on the post types mentioned in the background section above in the context of temporary fencing, the present invention can also be used with others post types that similarly have an accessible web or flange engagable by the grippers, for example including angle iron or U-channel posts used for road signage support or other ground-embedded applications.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A post puller for pulling a post from a ground embedded position standing upright from a ground surface, the post puller comprising:

a lifting member having a coupling point thereon that is configured for attachment to lifting arrangement of a working machine to enable upward lifting of said lifting member by the lifting arrangement of the working machine;

a sliding sleeve attached to the lifting member;

a guide shaft about which the sliding sleeve is disposed for axial sliding of the sleeve up and down along a longitudinal axis of the guide shaft;

a pair of movable grippers pivotally supported on the guide shaft by respective pivotal connections on opposing sides of a central longitudinal plane thereof at a fixed location along the longitudinal axis of the guide shaft, each movable gripper having an inner end with a cam-shaped gripping surface that faces across the central longitudinal plane of the guide shaft toward the cam-shaped gripping surface of the other movable gripper, and an opposing outer end spaced laterally outward to a respective side of the guide shaft, each cam-shaped gripping surface increasing in a radial distance thereof from a pivot axis of the respective pivotal connection in a direction moving upward from an imaginary axis intersecting the pivot axes of the pivotal connections;

a pair of links having upper ends pivotally coupled to the lifting member and respective lower ends each pivotally coupled to a respective one of the movable grippers proximate the outer end thereof, whereby raising of the lifting member by the working machine with a web or flange of the post received in a space between the inner ends of the movable grippers lifts the outer ends of the movable grippers via the pair of links, thereby lowering the inner ends of the grippers about the pivot axis and bringing the cam-shaped gripping surfaces into closer proximity to one another to grip the web or flange of the post between the gripping surfaces and pull the post from the embedded position under further raising of the lifting member by the working machine.

2. The post puller of claim 1 further comprising upper and lower braces situated above and below the movable grippers on a same side of the guide post as said movable grippers, each brace defining a slot for receiving the web or flange of the post therein to align the web or flange in the space between the inner ends of the grippers.

3. The post puller of claim 1 comprising a ledge projecting outward from the guide shaft to a same side thereof at which the movable grippers are disposed for resting of said ledge atop the post during placement of the post puller in an operational position situating the web or flange of the post in the space between the inner ends of the grippers.

4. The post puller of claim 2 comprising a ledge projecting outward from the guide shaft to the same side thereof as the pair of braces at a position above the upper brace for resting of said ledge atop the post during placement of the post puller in an operational position situating the web or flange of the post in the space between the inner ends of the grippers.

5. The post puller of claim 2 wherein the lower brace resides below the fixed position of the movable grippers at a further distance therefrom than the upper brace.

6. The post puller of claim 1 comprising at least one handle attached to the guide shaft.

7. The post puller of claim 6 wherein the at least one handle extends to a side of the guide shaft opposite the movable grippers.

8. The post puller of claim 6 wherein the at least one handle comprises a pair of handles each extending laterally outward from the post to a respective side thereof in opposing directions away from the central longitudinal plane of the guide shaft.

9. The post puller of claim 6 wherein each handle comprises an open grip handle having upper and lower arms attached to the guide shaft at spaced apart positions along the longitudinal axis, a central span joining the upper and lower arms together at a radial distance outward from the guide shaft, and an open space bound between the arms, the central span and the guide shaft for gripping of the handle through said open space.

* * * * *